US006241629B1

(12) United States Patent
Otto

(10) Patent No.: US 6,241,629 B1
(45) Date of Patent: Jun. 5, 2001

(54) BASEBALL AND SOFTBALL TRAINING APPARATUS AND METHOD

(75) Inventor: Gary D. Otto, Pryor, OK (US)

(73) Assignee: Sports Vision, Inc., Pryor, OK (US)

( * ) Notice: Subject to any disclaimer, the term of this patent is extended or adjusted under 35 U.S.C. 154(b) by 0 days.

(21) Appl. No.: 09/450,372

(22) Filed: Nov. 26, 1999

(51) Int. Cl.[7] ..... A63B 69/00

(52) U.S. Cl. ..... 473/457; 473/507; 473/513; 124/5

(58) Field of Search ..... 473/506–514, 473/573–576, 422–430; 273/329, 330; 124/4, 5, 8, 43, 65; D21/780, 722, 725

(56) References Cited

U.S. PATENT DOCUMENTS

| | | | | |
|---|---|---|---|---|
| 755,117 | * | 3/1904 | Dunn | 473/508 |
| 1,593,577 | * | 7/1926 | Kaiser | 473/511 |
| 1,865,173 | * | 6/1932 | Dickerman | 124/5 |
| 3,115,129 | * | 12/1963 | Merriman | 473/513 |

* cited by examiner

*Primary Examiner*—Jeanette Chapman
*Assistant Examiner*—Mitra Aryanpour
(74) *Attorney, Agent, or Firm*—Frank L. Hart

(57) ABSTRACT

A hand held mechanical apparatus for propelling a ball toward a person so that the person can gain experience in hitting and fielding, the apparatus has a tube for holding the ball and a spring for generating the energy to propel the ball from the tube.

15 Claims, 3 Drawing Sheets

BASEBALL AND SOFTBALL TRAINING APPARATUS AND METHOD

TECHNICAL FIELD

The subject invention relates to apparatus and method for use in training baseball and softball players. More particularly, the subject invention relates to apparatus and method for propelling a ball in a preselected direction toward a target.

BACKGROUND ART

In the training of baseball and softball players in the art of hitting and fielding the ball, it is necessary for someone to repeatedly throw a ball for them to hit or catch. As most are aware, development of skill in hitting and fielding requires years of experience and tens of thousands and even millions of balls thrown in the players direction for their gaining of experience in reacting to the flight and speed of the ball. Hand—Eye coordination is a most difficult skill to acquire.

In recent years, automatic pitching machines have been developed which propel a ball in a preselected flight patch toward a target. These are mechanical devices which are complicated and generally require an expenditure that is beyond the average person's available income budget.

It is therefore evident that the sport needs required a relatively inexpensive device that could be easily operated over extended periods of time and which required less energy to operate than that required by the actual throwing of a ball by an individual. It was also desirable to provide an apparatus that could be rapidly loaded with a ball. The present invention is directed to overcome one or more of the problems as set forth above.

DISCLOSURE OF THE INVENTION

In one aspect of the invention, the training apparatus comprises an elongated tube having a chamber and being open at one of its ends, a handle, a spring connecting the tube to the handle, and means for obstructing the tube chamber at a preselected distance along the tube from a first end of the tube.

In another aspect of the invention, a method is provided for inserting a ball into the chamber of the apparatus, gripping the handle in a prescribed manner, moving the tube to a recommended position, and releasing the tube and thereby propel the ball from the chamber of the apparatus and toward a preselected target.

BEST MODE FOR CARRYING OUT THE INVENTION

Figure 1:
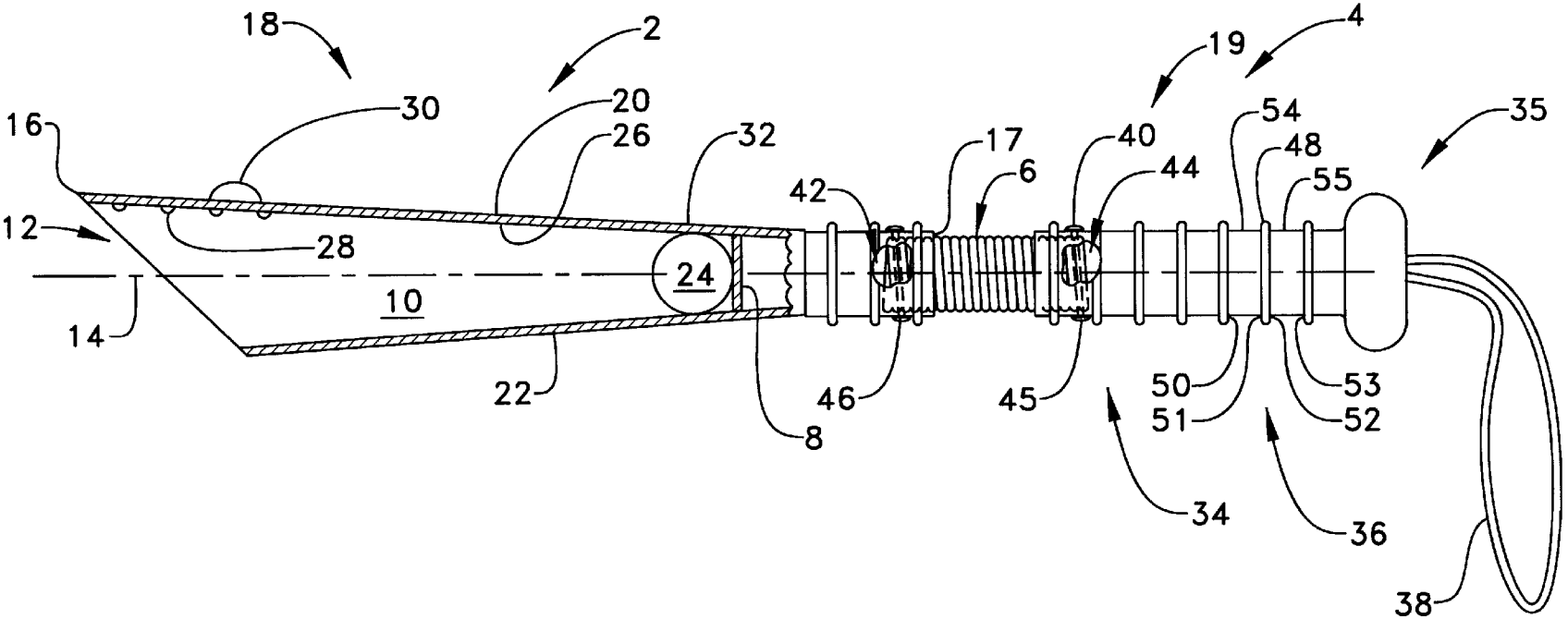
FIG. 1 is a diagrammatic side view in partial section of the preferred embodiment of the invention.

Referring to FIG. 1, which shows the preferred embodiment of this invention, the apparatus has an elongated tube 2, a handle 4 and a resilient device or spring 6 connected at one end to the tube 2 and at the other end to the handle 4. A bridge or obstructing means or element 8 is positioned within a chamber 10 of the tube 2 at a preselected distance from an open end 12 of the tube 2.

The elongated tube 2 has a longitudinal axis 14, first and second ends 16,17, first and second end portions 18,19 with the tube chamber 10 opening at the first end portion 18 of the tube 2. The tube chamber 10 extends a preselected longitudinal distance along the tube 2 from the tube first end 16 and terminates a preselected distance along the axis 14 with terminal end of the chamber 10 being defined by the obstructing element 8.

It should be noted that the tube chamber 10 opens on an angle relative to the tube longitudinal axis 14. The distance between the first and second tube ends 16,17, as measured along the tube's longitudinal axis, is greater than the distance as measured along the axis on a second or opposed side 22 of the tube 2.

The chamber 10 of the tube 2 has sidewalls which converge in a direction from the first end 16 of the tube 2 toward the tube second end 17. The tube sidewalls are preferably of uniform thickness and resultingly the chamber 10 has diameters which progressively increase in dimensions in a direction from the tube second end 17 toward the tube first end 16. At a location adjacent the obstructing means 8, the diameter of the chamber 10 is substantially equal to but greater than the diameter of a ball 24 expected to be used with the apparatus. In the preferred embodiment, the elongated tube 2 has an inner surface 26 and a portion of the inner surface 26 adjacent the tube first end portion 18 has protrusions 28 that functionally put a spin on a ball 24 exiting the chamber 10. A protrusion or flange 30 extends outwardly from the outer surface 32 of the tube 2 at a location adjacent the first end portion 18 of the tube 2 on the first side 20 of the tube 2.

The handle 4 has first and second end portions 34,35 and a middle portion 36. The second end portion 35 of the handle 4 has a diameter greater than the handle middle portion. This greater diameter is to help keep a user's hand from slipping off the second end of the handle 4. Preferably a wrist string or loop 38 is connected to the second end portion 35 of the handle 4 so that the user can release his grip from the apparatus and the apparatus will be maintained in close proximity to the user's hand. The wrist loop 38 is of a size sufficient for extending about the wrist of the user.

It is also preferred that the handle 4 includes a locating means 40 for indicating a preferred locating position for a user's thumb when grasping the handle 4. The locating means 40 can be of any form which tactically inform the user that his thumb is in the correct position on the handle 4. In the preferred embodiment of FIG. 1, the locating means 40 is one side of the fastening means or rivet 40 which connects the spring 6 to the handle 4 on an extension of the first side 20 of the tube 2. Stated differently, if the first side 20 of the tube 2 is at the highest elevation of the tube 2, the locating means 40 of the handle 4 will be at the highest elevation of the handle 4 in the assembled condition of the apparatus.

Figure 2:
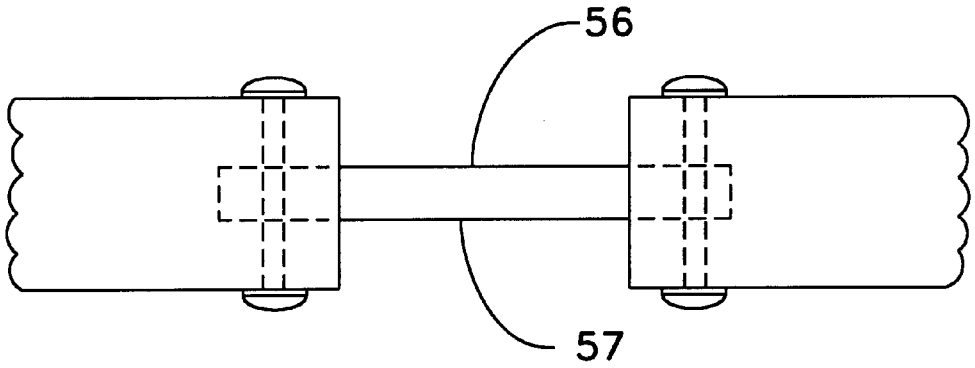
FIG. 2 is a diagrammatic side view in partial section of a portion of the apparatus of this invention which includes a different type spring than that utilized in the embodiment of FIG. 1.

Referring to FIGS. 1 and 2, the second end portion 19 of the tube 2 and the first end portion 34 of the handle 4 each have a respective spring opening 42,44 of a size sufficient for receiving end portions of the spring 6. Ends of the spring 6 are preferably fixedly connected to their respective tube 2 and handle 4 by rivets 45,46 each passing through their respective tube 2 and handle 4 and respective spring end portions. It should be understood that other fastening means such as bolts, screws etc. can be used without departing from this invention.

The handle middle portion 36 has an outer surface 48. This outer surface has a plurality of edges 50,51,52 53, which assist in preventing a user's hand from slipping. Preferably, these edges 50–53 are formed by grooves 54,55 extending circumferentially about the handle middle portion 36. Preferably there are a large number of these grooves, but only two are numbered for simplicity. The gripping edges 50–53 can be formed by other means, such as a plurality of projections or roughened surface, without departing from this invention.

Figure 3:
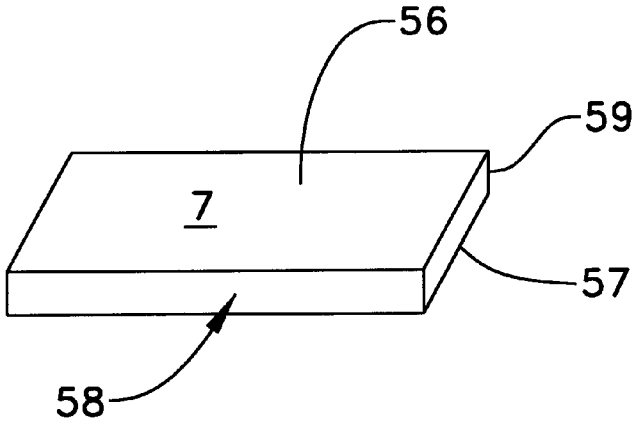
FIG. 3 is a diagrammatic perspective view of the leaf spring of FIG. 2.

Referring to FIGS. 2 and 3, another embodiment of the spring 7 is shown. In this alternate embodiment, the spring 7 is of the leaf spring type which has opposed first and second sides 56,57 and first and second opposed edges 58,59. The leaf spring first side 56 is oriented along the first side 20 of the tube 2. The leaf spring 7 is connected to the associated tube 2 and handle 4 in a like manner as set forth above.

Referring to FIG. 1, the obstructing element or means 8 is positioned within the tube chamber 10 at a location measured from the tube first end 17 outermost portion along the longitudinal axis a distance in the range of about 7 inches to about 12 inches, preferably about 9½ inches. A smaller distance than about 7 inches is undesirable because the ball will not travel a sufficient distance within the tube 2 to generate a desirable spin. A greater distance than about 12 inches is undesirable because the length would be so great that smaller individuals could not use the apparatus and larger individuals would find the "shooting" position to be uncomfortable.

As should be noted, the departing velocity of the ball from the tube 2 will be dependant upon the flexibility of the spring and the distance of the obstructing element 8 from the handle first end portion 34. As can be seen in phantom in FIG. 4, the ball 24 in contact with the obstructing element 8 passes through and arc. The greater the moment arm of the arc, the greater generally will be the velocity of the exiting ball 24. The ball velocity is also controlled by the position of the user's hand on the handle, as will be later described in more detail.

The tube 2 and handle 4 of the apparatus of this invention is preferably formed of organic plastic in order to maintain the apparatus easy to manufacture and relatively inexpensive.

The ball size preferred to be used in this invention are about 1½ inches. Although these small balls are harder to hit for a batter and harder to catch for a fielder, these 1½ inches balls, being smaller than a baseball or softball, they train the batter or fielder to impart greater concentration. However, other size balls can be used with this invention and the dimensions of the apparatus of this invention altered to accommodate the other ball sizes without departing from the invention. One of ordinary skill in mathematics can easily redesign the tube 2 to accommodate different ball sizes.

The construction of the balls used with this invention has also been found to be important. For baseball, it is preferred that the balls are of organic plastic, hollow and have a multiplicity of holes in the outer surface. For softball, it is preferred that the outer surface of the ball be free of holes. In this construction, the spin of the solid surface ball imparts a slight rise in trajectory thereby closely imitating the trajectory of a pitched softball.

Industrial Applicability

Figure 4:
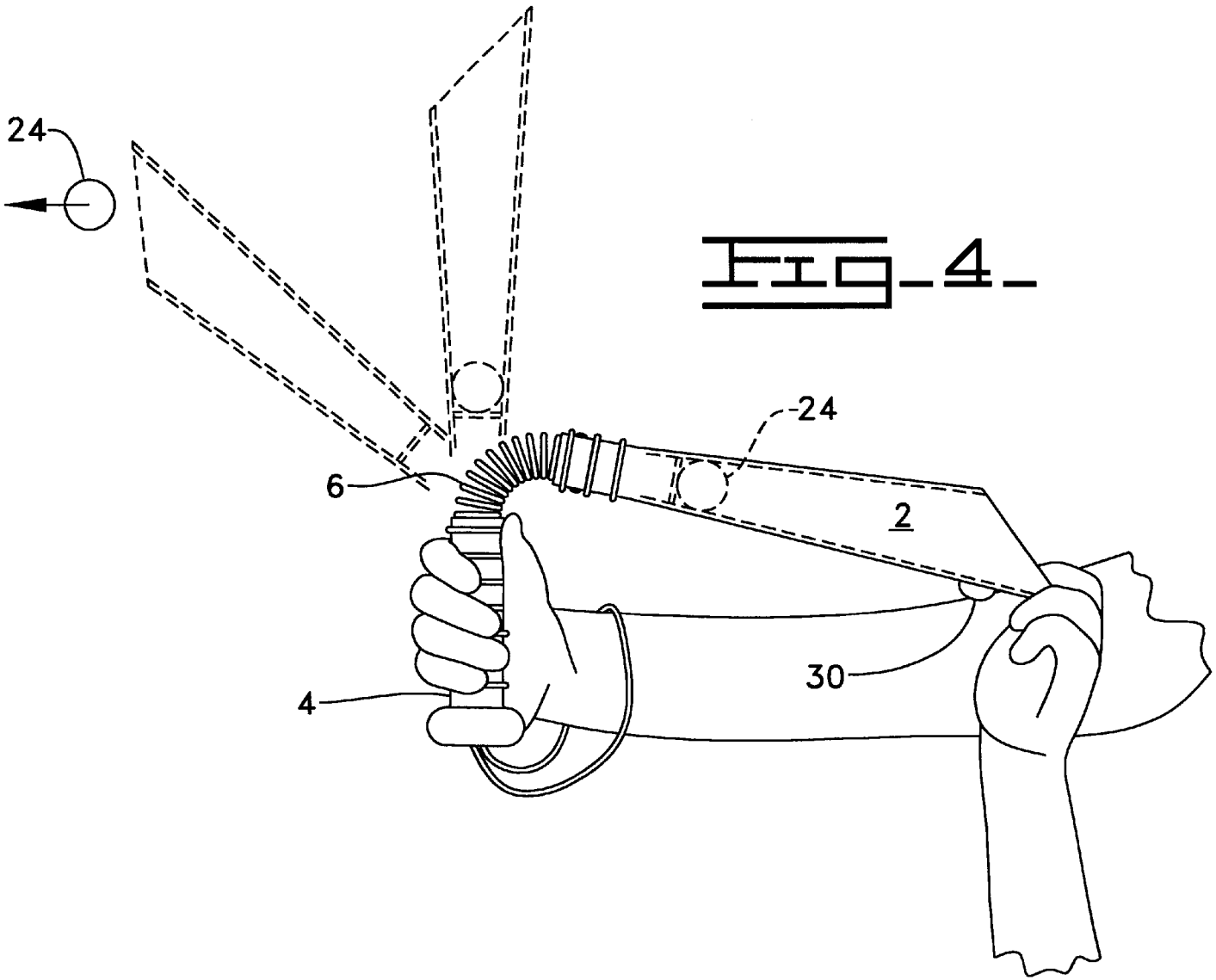
FIG. 4 is a diagrammatic partial side view of a user operating the apparatus of this invention.

Referring to FIG. 4, the training apparatus of this invention is operated by inserting a ball 24 into the chamber 10. The user then grips the handle 4 and places the user's thumb on the handle locating means 40. The user maintains the handle 4 in a generally vertical position and maintains the arm of his gripping hand in a fully extended position. The user then grasps the first side 20 of the tube 2 and moves the tube 2 to a position substantially parallel to the extended arm of the user. The user then releases the first end of the tube and thereby propels the ball, in response of release of spring tension, from the chamber of the apparatus and toward a preselected target.

The instant apparatus can also have additional elements and associated accessories. For example, if the thumb of the user's hand has been rotated and is adjacent the second end portion 35 of the handle, it has been discovered that the velocity of the ball will be less because there is a tendency to allow the handle 4 to drift to a position less than vertical. If desirable a second locating means (not shown) can be positioned adjacent the handle second end portion 35.

With little practice a user can become most proficient in accurately discharging balls toward the target. It is important however that in the ready to fire position shown by solid lines in FIG. 4 that the first side 20 of the tube 2 be parallel to the user's extended arm. The preferred flange 30, if present, assists in reminding the user of the correct position by touching of the flange 30 to his arm when the correct position has been reached.

There are a number of accessories that are known in the art than can be readily used with the apparatus of this invention. A ball bag having a shoulder strip will hold and position balls for rapid loading of the chamber. Another accessories is a ball pick up tube which is also known in the art. It has also been found advantageous in training for a small net, like a minnow net, to be attached to a fielders hat bill. The fielder trying to catch the ball in the net will learn to get under the ball and stop as opposed to transversely arriving at the ball at the instant the ball comes within reach.

Other aspects, objects, and advantages of this invention can be obtained from a study of the drawings, the disclosure and the appended claims.

What is claimed is:

1. A training apparatus, comprising:

an elongated tube having an axis, first and second ends, first and second end portions, and an open chamber extending a preselected longitudinal distance therethrough, said chamber opening on said first end portion at an angle relative to the tube longitudinal axis wherein the distance as measured along the tube longitudinal axis is greater on a first side of the tube than on a second opposed side of said tube and having a flange extending outwardly from an outer surface adjacent the first end portion of the tube on the first side of said tube;

means for obstructing the tube chamber at a preselected longitudinal distance along the tube from the tube first end;

a handle; and a spring having first and second end portions and being connected said first end to the handle and at said second end to the second end portion of the elongated tube.

2. An training apparatus, as set forth in claim 1, including locating means on the handle for indicating a locating position for a user's thumb, said locating means being oriented along an extension of a first side of the tube.

3. A training apparatus, as set forth in claim 1, wherein the spring is a leaf spring having first and second opposed sides and first and second edges, said leaf spring first side being oriented along the first side of the tube.

4. A training apparatus, as set forth in claim 1, wherein the obstructing means is positioned within the tube chamber at a location measured from the tube first end outer most portion along the longitudinal axis a distance in the range of about 7 inches to about 12 inches.

5. A training apparatus, as set forth in claim 4, wherein said distance is about 9½ inches.

6. A training apparatus, as set forth in claim 1, wherein the spring is a helical spring.

7. A training apparatus, as set forth in claim 1, wherein the tube chamber has diameters which progressively increase in dimensions in a direction from the tube second end toward the tube first end.

8. A training apparatus, as set forth in claim 1, wherein the diameter of the tube chamber at a location adjacent the obstructing means is greater than the diameter of a ball expected to be used with the apparatus.

9. A training apparatus, as set forth in claim 1, wherein the second end portion of the tube and the first end portion of the handle each have a spring opening and end portions of the spring extend into respective spring openings.

10. A training apparatus, as set forth in claim 1, wherein the handle has first and second end portion and a middle portion, said handle second end portion being of a greater outside diameter than said handle middle portion.

11. A training apparatus, as set forth in claim 1, wherein said handle has a middle portion having an outer surface, said outer surface of said handle middle portion having edges for gripping said handle.

12. A training apparatus, as set forth in claim 11, wherein said edges are formed by a plurality of grooves circumferentially extending about the handle middle portion.

13. A training apparatus, as set forth in claim 1, wherein the spring is connected to the elongated tube and the handle by rivets.

14. A training apparatus, as set forth in claim 1, including a wrist loop connected to the second end of the handle and being of a size sufficient for extending about a wrist of a user.

15. A training apparatus, as set forth in claim 1, wherein the elongated tube has an inner surface and said inner surface has protrusions about at least a portion of the first end portion of the tube.

* * * * *